US007823736B1

(12) United States Patent
Pugne et al.

(10) Patent No.: US 7,823,736 B1
(45) Date of Patent: Nov. 2, 2010

(54) PLASTIC CLOSURE HAVING MOUNTING RING FOR CONTAINERS

(75) Inventors: Darin M. Pugne, Holland, OH (US); Edward A. Grant, Northwood, OH (US); Leonora M. Brozell, Maumee, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 1048 days.

(21) Appl. No.: 11/474,754

(22) Filed: Jun. 26, 2006

Related U.S. Application Data

(63) Continuation-in-part of application No. 11/095,961, filed on Mar. 30, 2005, now abandoned.

(51) Int. Cl.

| | |
|---|---|
| ***B65D 39/00*** | (2006.01) |
| ***B65D 41/00*** | (2006.01) |
| ***B65D 41/18*** | (2006.01) |
| ***B65D 43/14*** | (2006.01) |
| ***B65D 47/00*** | (2006.01) |

(52) U.S. Cl. ..... 215/235; 215/232; 215/237; 220/359.1; 220/254.3; 220/258.1; 220/780; 220/DIG. 13; 220/837; 222/562; 222/556

(58) Field of Classification Search ..... 215/232, 215/237, 350, 351; 220/359.1, 254.3, 319, 220/258.1, 256.1, 780, DIG. 13, 838; 222/556, 222/546, 562

See application file for complete search history.

(56) References Cited

U.S. PATENT DOCUMENTS

| | | | | |
|---|---|---|---|---|
| 2,388,738 A | | 11/1945 | Gudheim | |
| 2,625,306 A | * | 1/1953 | Peter | 222/498 |
| 3,214,881 A | | 11/1965 | Hayes | |
| 3,216,610 A | | 11/1965 | Klygis | |
| 3,254,812 A | | 6/1966 | Abbott | |
| 3,733,015 A | | 5/1973 | Marques | |
| 3,845,872 A | | 11/1974 | Towns et al. | |
| 4,280,632 A | * | 7/1981 | Yuhara | 215/331 |
| 4,397,400 A | | 8/1983 | Walter | |
| 5,383,565 A | | 1/1995 | Luch | |
| 5,664,694 A | * | 9/1997 | Bietzer et al. | 215/256 |

(Continued)

FOREIGN PATENT DOCUMENTS

| | | | |
|---|---|---|---|
| CH | 117967 | A | 12/1926 |

(Continued)

*Primary Examiner*—Robin Hylton
(74) *Attorney, Agent, or Firm*—Reising Ethington PC

(57) ABSTRACT

A plastic closure for receipt on a container includes a plastic ring having an internal recess adapted to be received by snap fit over an external crown or bead on the container neck finish such that the ring is retained against axial movement on the container neck finish. A plastic lid is coupled by a hinge to the ring, with the ring, the lid and the hinge being of one-piece integrally molded plastic construction. The lid has a skirt that is adapted releasably to be snapped to the ring in a closed position of the lid over the ring. The lid skirt may have an external bead that is adapted to be received by snap-fit within an internal channel on the ring in the closed position of the lid over the ring, and a conical internal surface on the ring may be provided to guide the bead on the lid into the channel on the ring.

43 Claims, 9 Drawing Sheets

U.S. PATENT DOCUMENTS

| | | | |
|---|---|---|---|
| 5,860,543 | A | 1/1999 | Decelles |
| 5,893,489 | A | 4/1999 | Giarrante |
| 6,116,441 | A | 9/2000 | Decelles et al. |
| 6,260,723 | B1 | 7/2001 | Bergholtz |
| 6,299,033 | B1 | 10/2001 | VerWeyst et al. |
| 6,352,185 | B1 | 3/2002 | Arabnia |
| 6,394,323 | B2 | 5/2002 | McClean et al. |
| 6,622,895 | B2 | 9/2003 | McClean et al. |
| 2003/0006253 | A1 | 1/2003 | Yelton et al. |
| 2004/0056040 | A1 | 3/2004 | Ziegler |

FOREIGN PATENT DOCUMENTS

| | | | |
|---|---|---|---|
| CH | 619413 | A5 | 9/1980 |
| CH | 675410 | A5 | 9/1990 |
| DE | 19743924 | A1 | 4/1999 |
| DE | 20115489 | U1 | 12/2001 |
| EP | 1157933 | | 11/2001 |
| EP | 0132992 | A | 10/2002 |
| GB | 2313367 | A | 11/1997 |
| WO | WO 94/13545 | | 6/1994 |
| WO | WO 02/40365 | A1 | 5/2002 |
| WO | WO 02/081316 | A1 | 10/2002 |
| WO | WO 2004/094238 | A2 | 11/2004 |

* cited by examiner

PLASTIC CLOSURE HAVING MOUNTING RING FOR CONTAINERS

This application is a continuation-in-part of application Ser. No. 11/095,961 filed Mar. 30, 2005 and now abandoned.

The present disclosure relates to securement of plastic closures to containers, particularly glass containers.

BACKGROUND AND SUMMARY OF THE DISCLOSURE

A general object of the present disclosure is to provide a plastic closure for securement over an external bead on a container neck finish, preferably a glass container neck finish, and/or to provide a package that includes a plastic closure received by snap fit over an external bead on the container neck finish.

The present disclosure involves a number of aspects that can be implemented separately from or in combination with each other.

A plastic closure for receipt on a container, preferably but not necessarily a glass container, in accordance with one aspect of the present disclosure, includes a plastic ring having an internal recess adapted to be received by snap fit over an external bead on the container neck finish such that the ring is retained against axial movement on the container neck finish. A plastic lid is coupled by a hinge to the ring, with the ring, the lid and the hinge being of one-piece integrally molded plastic construction. The lid has a skirt that is adapted releasably to be snapped to the ring in a closed position of the lid over the ring. The lid skirt may have an external bead that is adapted to be received by snap-fit within an internal channel on the ring in the closed position of the lid over the ring, and a conical internal surface on the ring may be provided to guide the bead on the lid into the channel on the ring.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
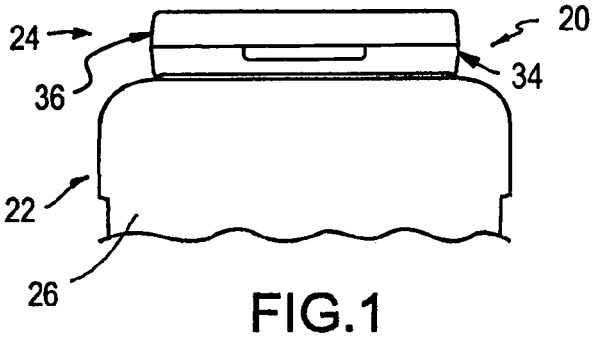
FIG. 1 is a fragmentary elevational view of a package in accordance with an exemplary embodiment of the present disclosure.
Figure 2:
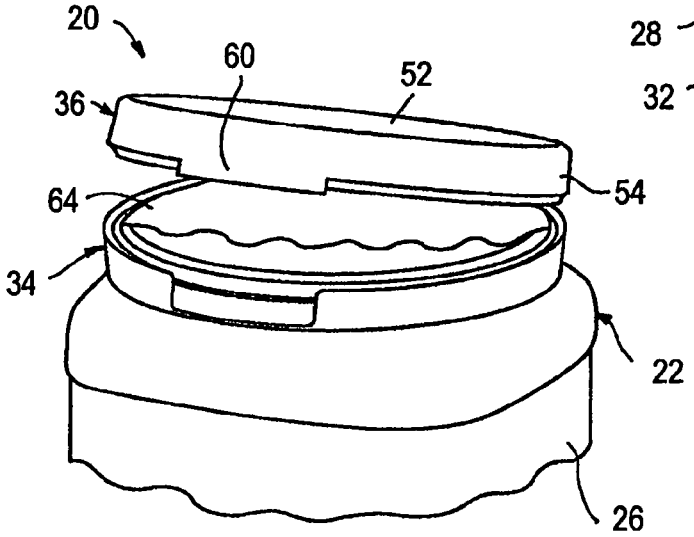
FIG. 2 is a fragmentary perspective view of the package in FIG. 1 with the closure lid partially opened.
Figure 3:
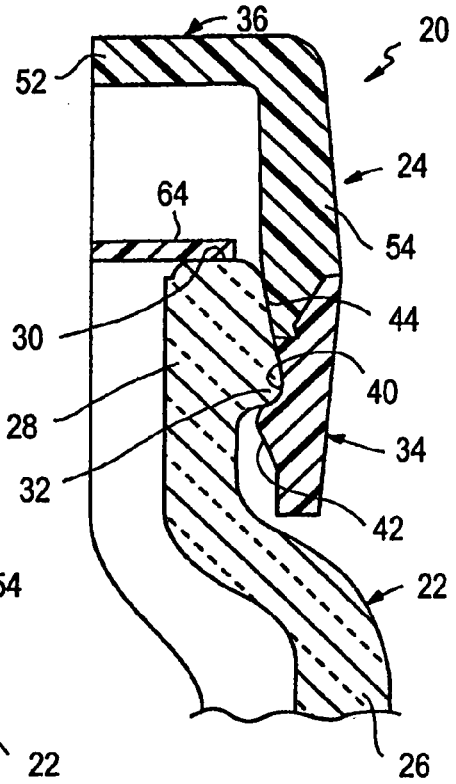
FIG. 3 is a fragmentary sectional view of the package illustrated in FIG. 1.
Figure 4:
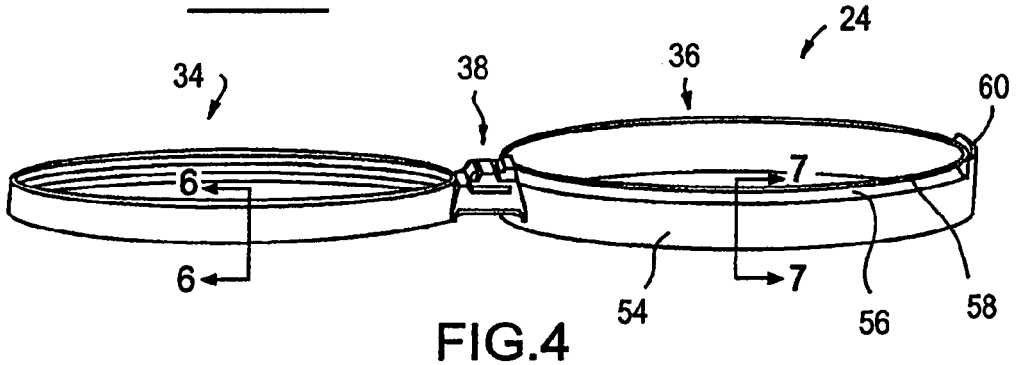
FIG. 4 is a side perspective view of the closure in the package of FIGS. 1-3 as molded.
Figure 5:
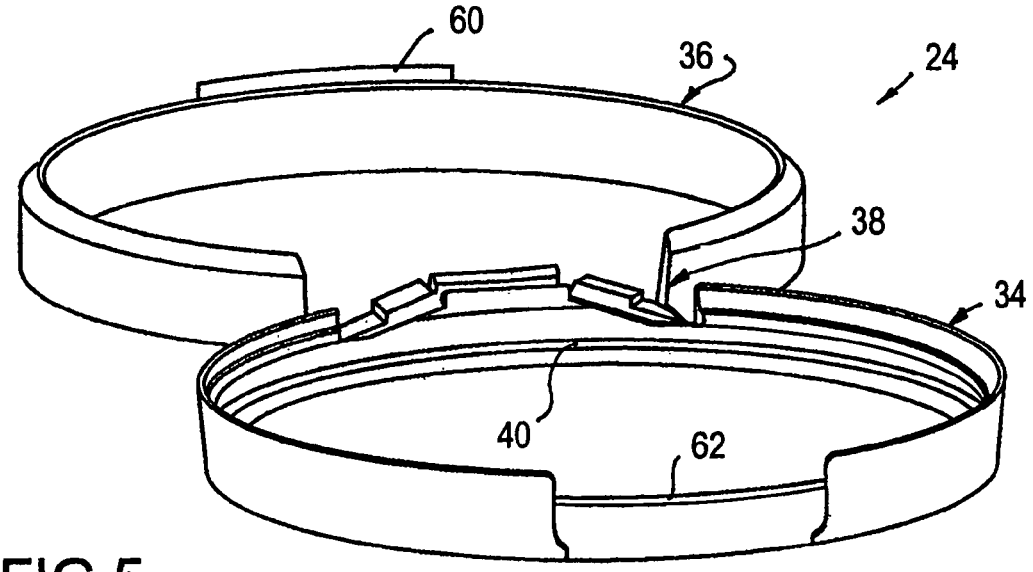
FIG. 5 is an end perspective view of the closure in FIG. 4.

FIGS. 1-3 illustrate a package 20 in accordance with one exemplary embodiment of the present disclosure. Package 20 includes a closure 24 secured to a container 22. Container 22 has a body 26 from which a neck finish 28 axially extends. Neck finish 28 preferably is cylindrical and typically is coaxial with body 26, although this need not necessarily be the case. Body 26 may be of any suitable geometry such as cylindrical or rectangular. Neck finish 28 has an open end 30 and an external crown or bead 32. External bead 32 preferably is circumferentially continuous. Container 22 may be made by any suitable technique, and the geometries of FIGS. 1-3, 8-12, 15, 17 and 19-20 are exemplary. Although the closure and package of the present disclosure are particularly suitable for wide-mouth container applications as illustrated in FIGS. 1-3, 8-11 and 19-20, the disclosure also can be implemented in other applications, such as narrow-neck container applications (FIGS. 12-18). Container 22 preferably is of glass construction (FIGS. 1-3, 12, 15, 17 and 19-20), but may be of plastic construction (FIG. 10).

Closure 24 preferably is of one-piece integrally molded plastic construction, and includes a mounting base or ring 34 connected to a lid 36 by a hinge 38. Hinge 38 may be of any suitable type, but preferably is formed by a pair of laterally spaced hinge elements. This lateral spacing between the hinge elements contributes to the stability of lid 36 with respect to ring 34. The specific exemplary hinge 38 illustrated in the drawings is disclosed in U.S. Pat. No. 6,041,477. Other types of hinges, such as single element hinges and film hinges, can be employed. Closure 24 may be of any suitable one-piece integrally molded plastic.

Figure 6:
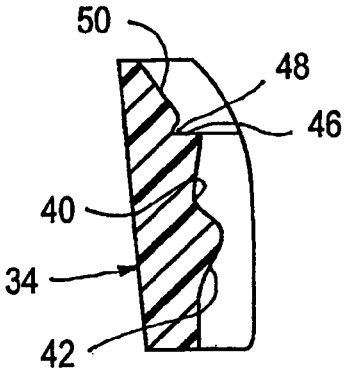
FIGS. 6 and 7 are fragmentary sectional views taken substantially along the respective lines 6-6 and 7-7 in FIG. 4.
Figure 7:
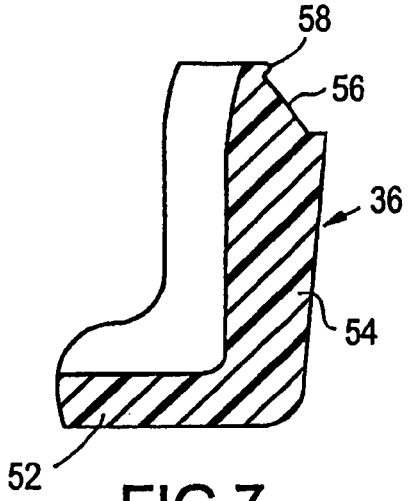

Ring 34 (FIGS. 3-7) is circumferentially continuous and has a circumferentially continuous internal recess 40 that is received by snap fit in assembly over external bead 32 on container neck finish 28. A conical internal surface 42 (FIGS. 3 and 6) on ring 34 cooperates with a conical external surface 44 (FIG. 3) on container neck finish external bead 32 for guiding and resiliently stretching ring 34 onto neck finish 28 until bead 32 is received by snap fit into recess 40.

Adjacent to the end of ring 34 remote from surface 42, there is a ledge or shoulder 46 (FIG. 6) that extends radially inwardly from an internal channel 48. A conical surface 50 extends radially and axially from a position adjacent to channel 48 for purposes to be described.

Lid 36 has a base wall 52 and a peripheral skirt 54. Skirt 54 preferably is circumferentially continuous except as hinge 38. At the free edge of skirt 54 spaced from base wall 52 there is a conical surface 56 (FIG. 7) that extends radially inwardly and axially away from base wall 52. Conical surface 56 terminates at a circumferential external bead 58. Bead 58 preferably is circumferentially continuous except at hinge 38 and latch 60. Latch 60 is provided on lid 36, preferably at a position diametrically spaced from hinge 38. Latch 60 extends from skirt 54 of lid 36, and is adapted to engage a corresponding latch element 62 on ring 34 diametrically spaced from hinge 38. Latch 60 and latch element 62 may be of any suitable type, being illustrated only schematically in the drawings.

A foil seal 64 (FIGS. 2-3) may be received over the open end 30 of container finish 28. Foil seal 64 may comprise a suitable disk, such as a multilayer disk having adjacent metal and plastic layers for induction heat-sealing securement of seal 64 to the end of the container finish.

In use, closure 24 is secured to container neck finish 28 either before or after filling the container with product. Container 22 can be filled with product and seal 64 secured to end 30 of container neck finish 28 before securement of closure 24. Closure 24 can be secured to container neck finish 28 by urging mounting ring 34 along surface 44 of bead 32 resiliently to expand the ring until the ring snaps over bead 32. This securement of ring 34 to bead 32 may be accomplished with lid 36 open or, more preferably, closed. To open lid 36 and dispense product, a user's thumb is positioned beneath latch 60 and lid 36 is pushed upwardly (in the orientation of FIGS. 1-3). Foil seal 64 then is removed from container neck finish 28, which provides a tamper indication that the package has been opened. After product has been dispensed from the package, lid 36 is pivoted toward the closed position. As the lid approaches the closed position, bead 58 on lid skirt 54 engages surface 50 on ring 34 to center lid 36 with respect to mounting ring 34. Further downward pressure on lid 36 snaps bead 58 into channel 48, so that the lid is secured to the mounting ring by snap fit and the edge of skirt 54 engages shoulder 46 on ring 34. Conical surfaces 50, 56 are in facing engagement with each other. Because ring 34 is disposed beneath the end of neck finish 28 in this embodiment (FIG. 3), the inside edge of lid skirt 54 engages the outside edge of surface 44 so that skirt 54 is captured between surface 44 and ring 34. This contributes to the stability of the closure on the container. Bead 58 cooperates with channel 48 to provide a seal when the lid is in the closed position.

Figure 8:
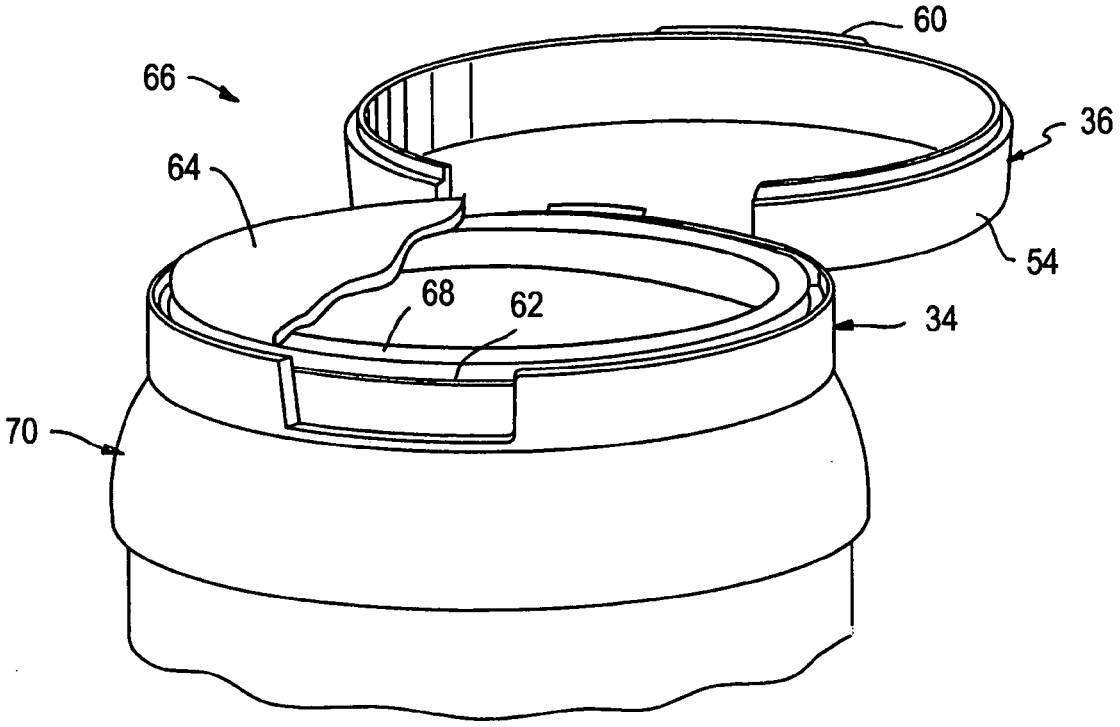
FIG. 8 is a fragmentary perspective view of a package in accordance with another exemplary embodiment of the present disclosure.
Figure 9:
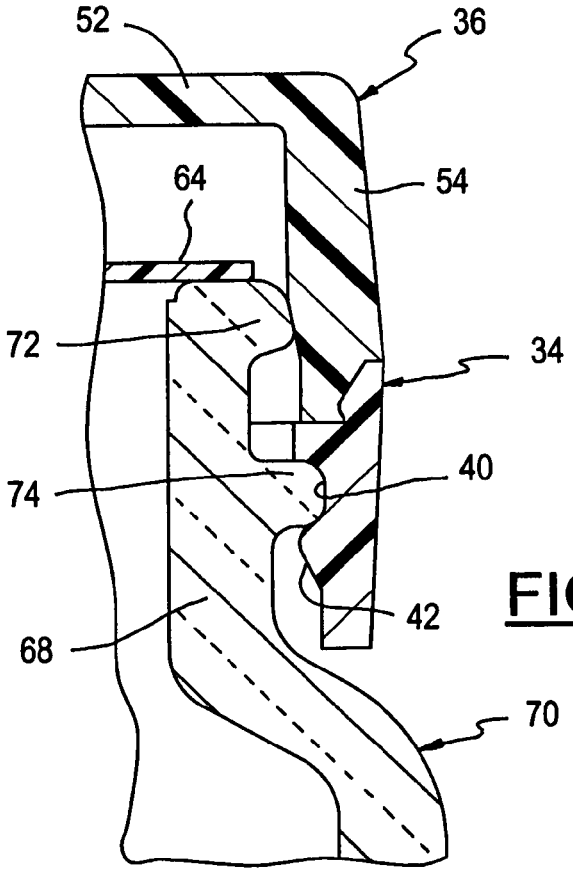
FIG. 9 is a fragmentary sectional view of the package in FIG. 8 with the lid closed.
Figure 10:
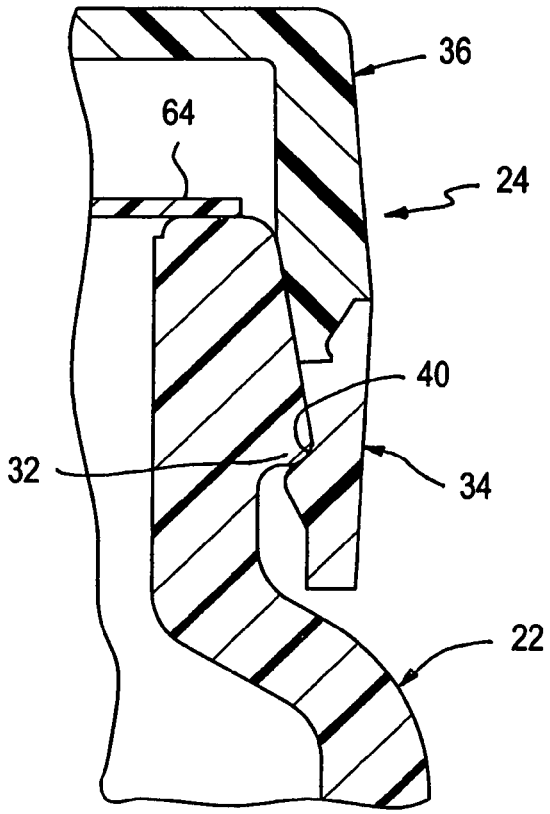
FIG. 10 is a fragmentary sectional view of the closure of FIGS. 1-7 on a plastic container neck finish.
Figure 11:
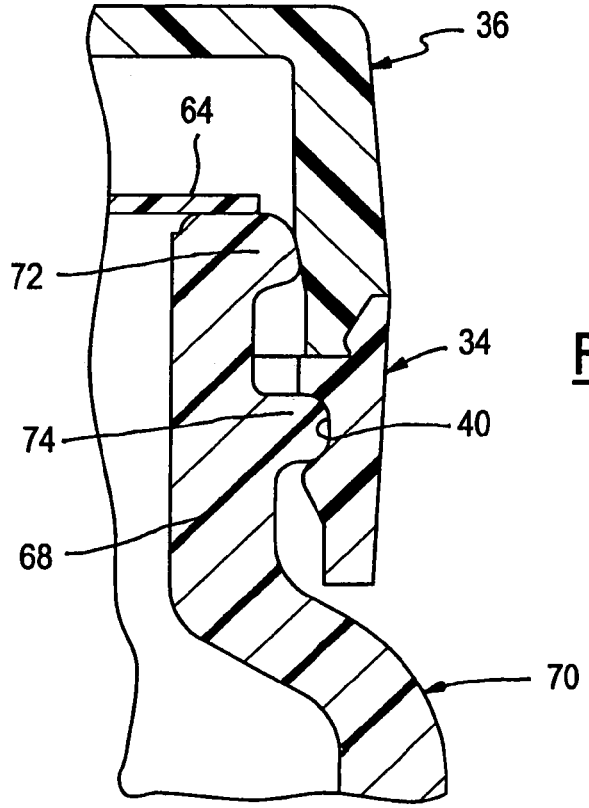
FIG. 11 is a fragmentary sectional view of the closure of FIGS. 8-9 on a plastic container neck finish.

FIGS. 8 and 9 illustrate a package 66 in accordance with a second exemplary embodiment of the disclosure. Reference numerals employed in FIGS. 8 and 9 (and FIGS. 10-25) that are identical with those employed in FIGS. 1-7 illustrate correspondingly identical or related components. The primary difference between the package of FIGS. 8-9 and the package of FIGS. 1-7 is that the neck finish 68 of container 70 has a pair of axially spaced external beads 72, 74. In the particular embodiment illustrated in FIG. 9, lower bead 74 has a greater outside diameter than upper bead 72. Mounting ring 34 is received by snap-fit over lower bead 74. The internal surface of skirt 54 on lid 36 engages the radially outer edge of upper bead 72 in the closed position of lid 36, as illustrated in FIG. 9. In this way, bead 72 cooperates with lid 36 to stabilize the lid in the closed position of the package and to center the lid during closure. Container 70 preferably is of glass construction (FIGS. 8-9), but may be of plastic construction (FIG. 11).

Figure 12:
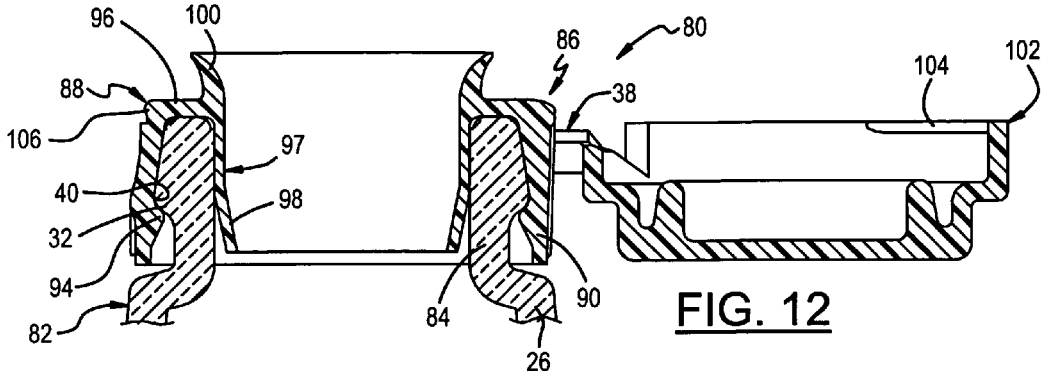
FIG. 12 is a sectional view of a package in accordance with a further exemplary embodiment of the present disclosure.

FIG. 12 illustrates a package 80 in accordance with a further embodiment of the disclosure. Package 80 includes a container 82 having a narrow-neck finish 84 with an external crown or bead 32. A closure 86 includes a base or ring 88 with an external flange or skirt 90 having an internal bead 94 forming recess 40 received by snap fit over external bead 32 on neck finish 84. Closure ring 88 also has a deck 96, preferably flat and annular, that is received against the end of neck finish 84. An annular pour lip 97 has an inner portion 98 that extends from deck 96 and is received within neck finish 84, and an outer portion 100 that extends from inner portion 98 and deck 96. Closure 86 also includes a lid 102 connected by hinge 38 to ring 88 for movement between an open position illustrated in FIG. 12 and a closed position overlying deck 96 and external portion 100 of pour lip 97. Lid 102 has in internal bead 104 adapted to be received by snap-fit over an external bead 106 on ring 88 adjacent to deck 96 to hold lid 102 in the closed position.

Figure 13:
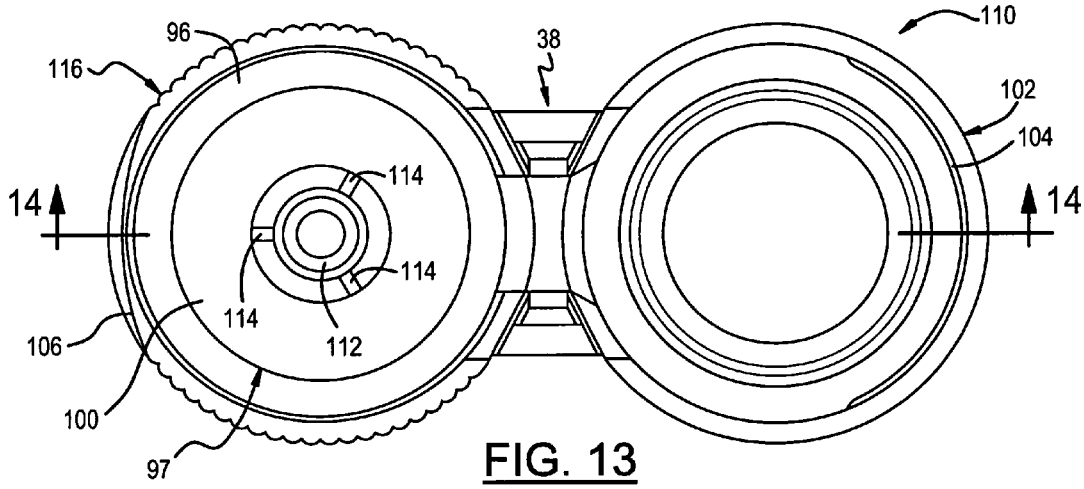
FIG. 13 is a top plan view of a closure in accordance with yet another embodiment of the present disclosure.
Figure 14:
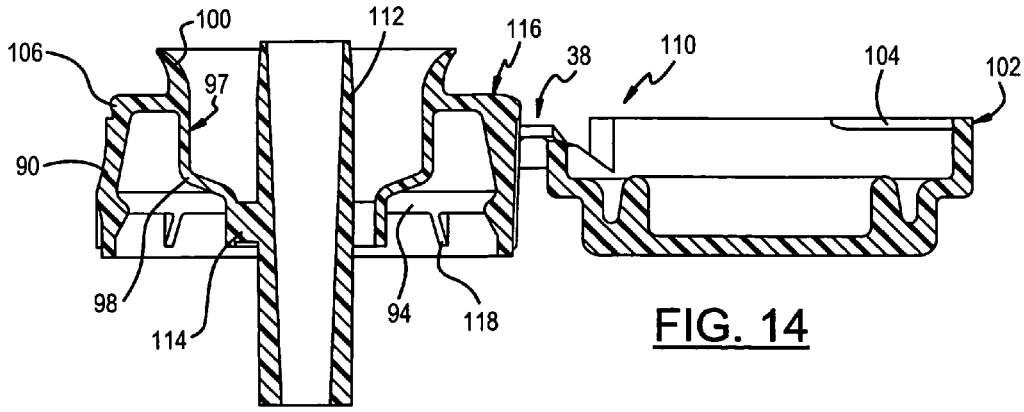
FIG. 14 is a sectional view taken substantially along the line 14-14 in FIG. 13.

FIGS. 13 and 14 illustrate a closure 110 that is a modification to closure 86 in FIG. 12. In closure 110, there is a tube 112 integrally mounted within the inner portion 98 of pour lip 97 by means of angularly spaced radially extending spokes 114. Tube 112 vents air into the package as product flows between spokes 114 when the package is tilted for dispensing. As shown in FIG. 14, bead 94 in the ring 116 of closure 110 (and bead 94 in ring 88 of closure 86 in FIG. 12) preferably is buttressed by a plurality of angularly spaced gussets 118. Gussets 118 both assist application of closure 116 (and closure 88) to the container neck finish, and resist distortion of flange 90 and thereby help prevent unintentional removal of the closure from the container neck finish.

Figure 15:
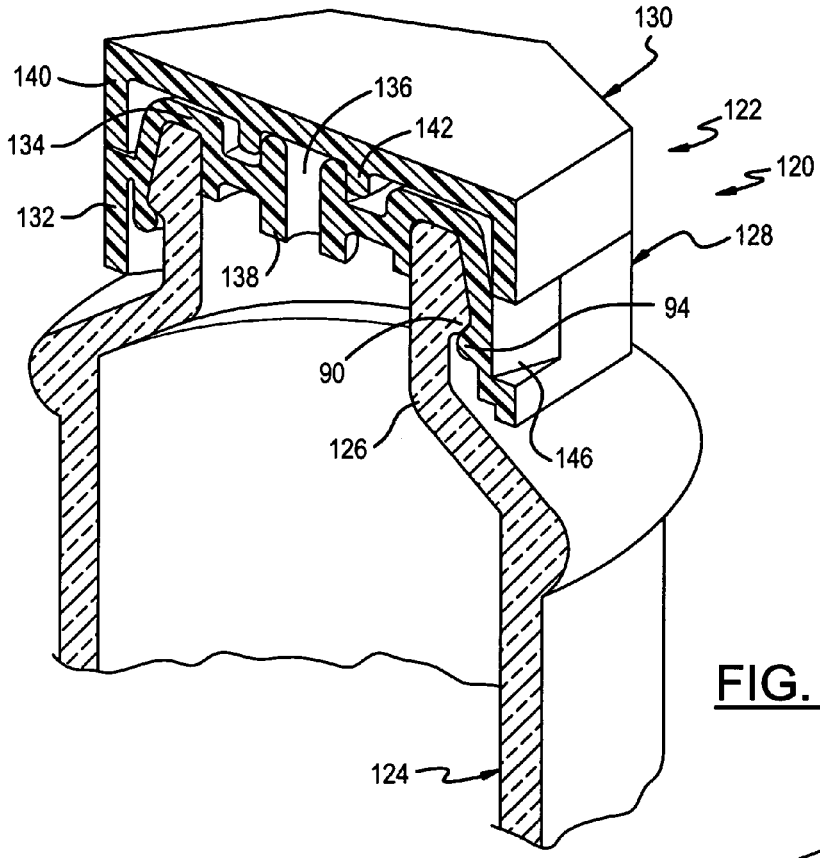
FIG. 15 is a fragmentary sectional perspective view of a package in accordance with a further embodiment of the present disclosure.
Figure 16:
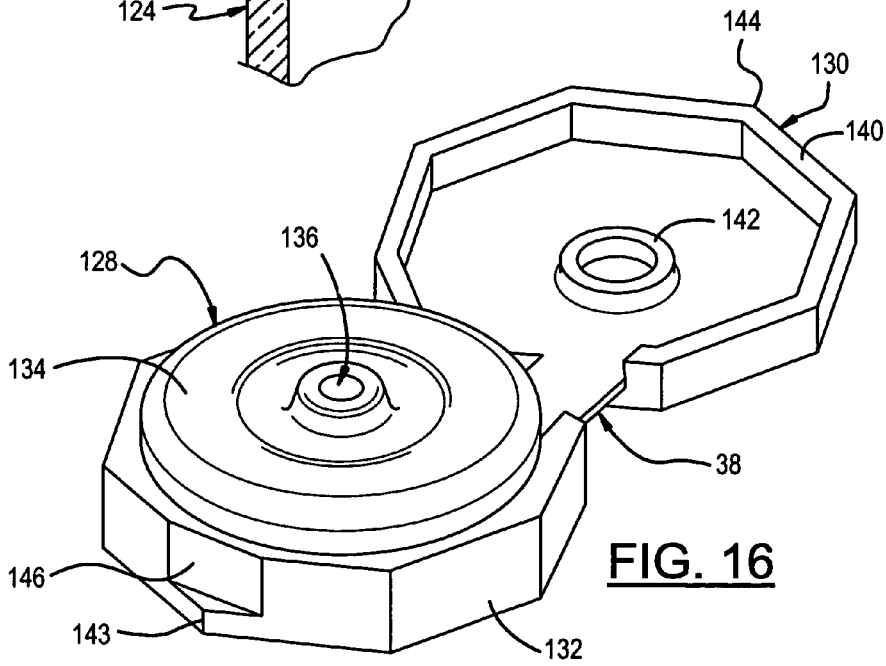
FIG. 16 is a perspective view of the closure in the package of FIG. 15 with the lid open.
Figure 17:
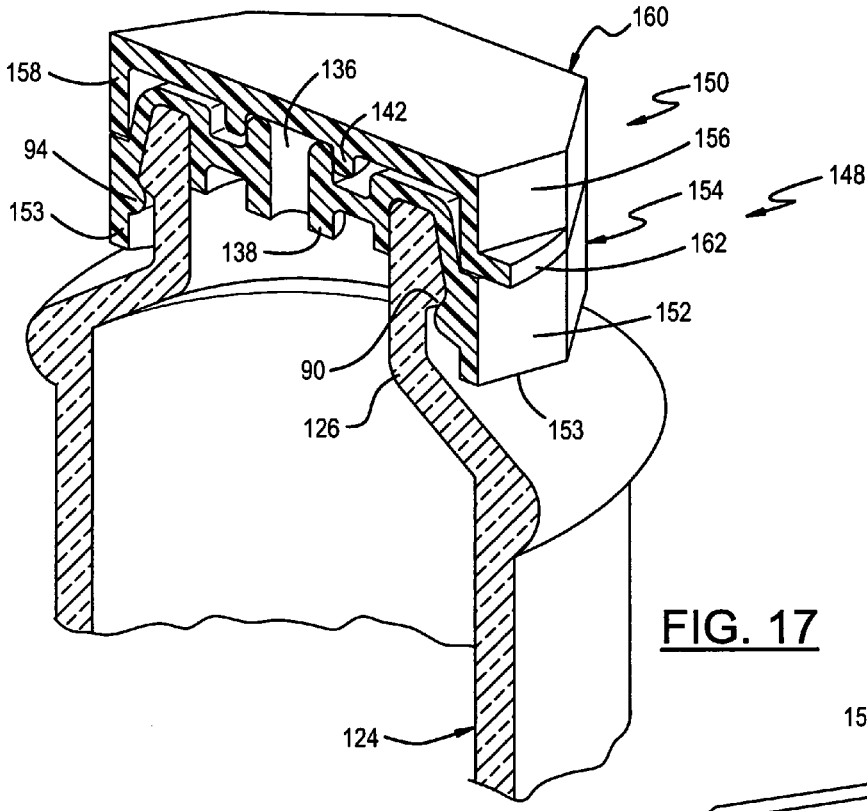
FIG. 17 is a fragmentary sectional perspective view of a package in accordance with another embodiment of the present disclosure.
Figure 18:
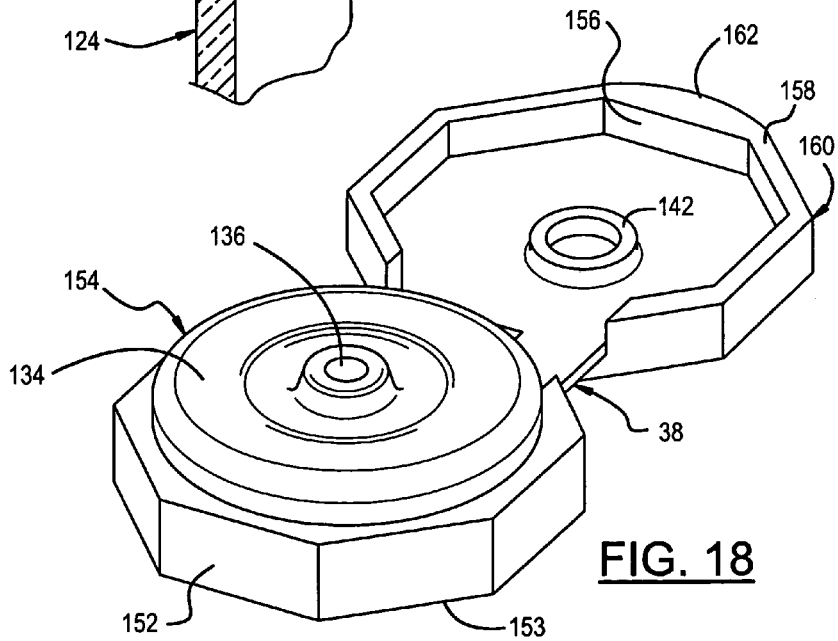
FIG. 18 is a perspective view of the closure in FIG. 17 with the lid open.

FIG. 15 illustrates a package 120 that includes a closure 122 (FIGS. 15 and 16) applied to the neck finish 126 of a container 124. Closure 122 includes a base or ring 128 received by snap-fit over the external bead 90 on the container neck finish as previously described. A lid 130 is coupled to base 128 by a hinge 38. Ring 128 has an external skirt or flange 132 with internal bead 94 and a deck 134 with a dispensing opening 136 surrounded by an annular wall 138. Lid 130 has an outer peripheral skirt 140 and an inner protrusion 142 for sealing dispensing opening 136 in the closed position of the lid. Protrusion 142 in FIGS. 15 and 16 comprises an annular wall that externally engages annular wall 138 above deck 134 when lid 130 is closed (FIG. 15). Skirt 140 of lid 130 and skirt 132 of ring 128 have polygonal geometries that align with each other in the closed position of the lid (FIG. 15). In the embodiment of FIGS. 15 and 16 (and the embodiment of FIGS. 17 and 18), these geometries are octagonal. In the embodiment of FIGS. 15 and 16, a corner 143 of the polygonal geometry of ring 128 is disposed opposite hinge 38, and a corner 144 of lid 130 is disposed opposite the hinge. A thumb recess 146 on skirt 132 at corner 143 enables corner 144 of lid 130 to be used for opening the lid. Package 148 and closure 150 in the embodiment of FIGS. 17-18 are similar to package 120 and closure 122 in FIGS. 15-16 except that a flat section 152 of skirt 153 on ring 154 is disposed opposite hinge 38, and a flat section 156 on the skirt 158 of lid 160 is disposed opposite hinge 38. A thumb tab 162 extends outwardly from flat skirt section 156 to overlie flat skirt section 152 on ring 154 for opening the lid.

Figure 19:
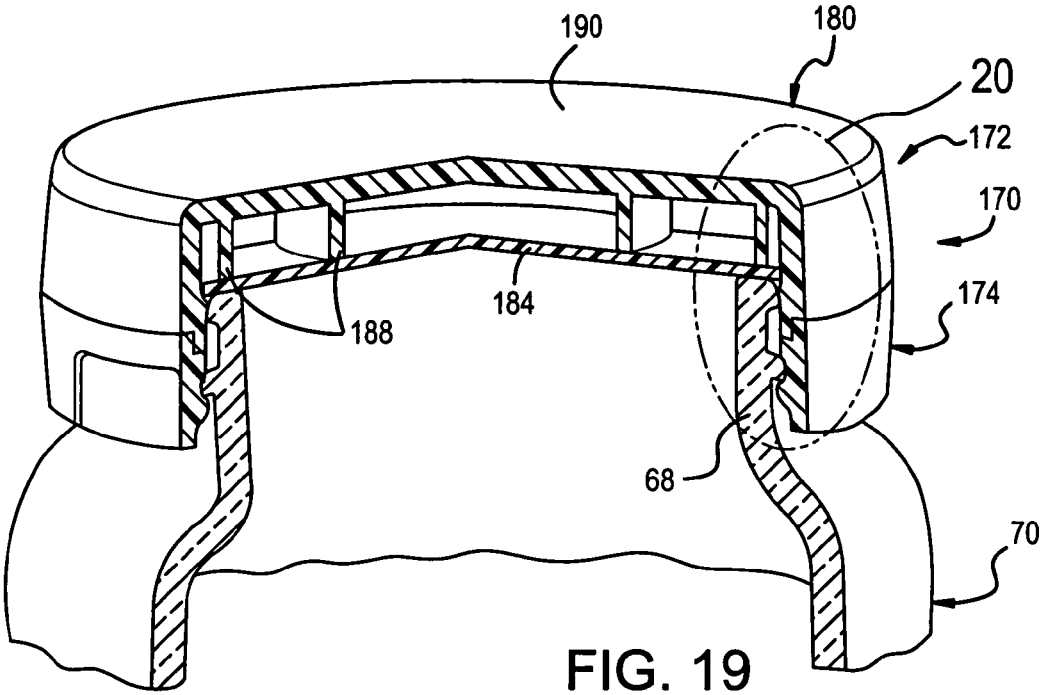
FIG. 19 is a fragmentary sectional perspective view of a package in accordance with another embodiment of the present disclosure.
Figure 20:
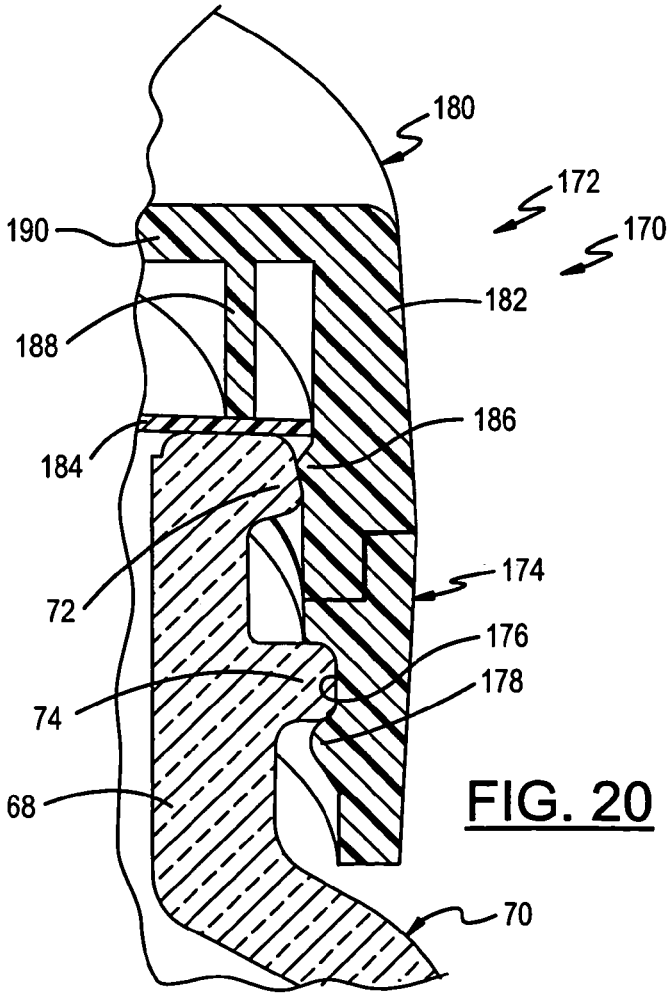
FIG. 20 is a fragmentary sectional view on an enlarged scale of the portion of FIG. 19 within the area 20.
Figure 21:
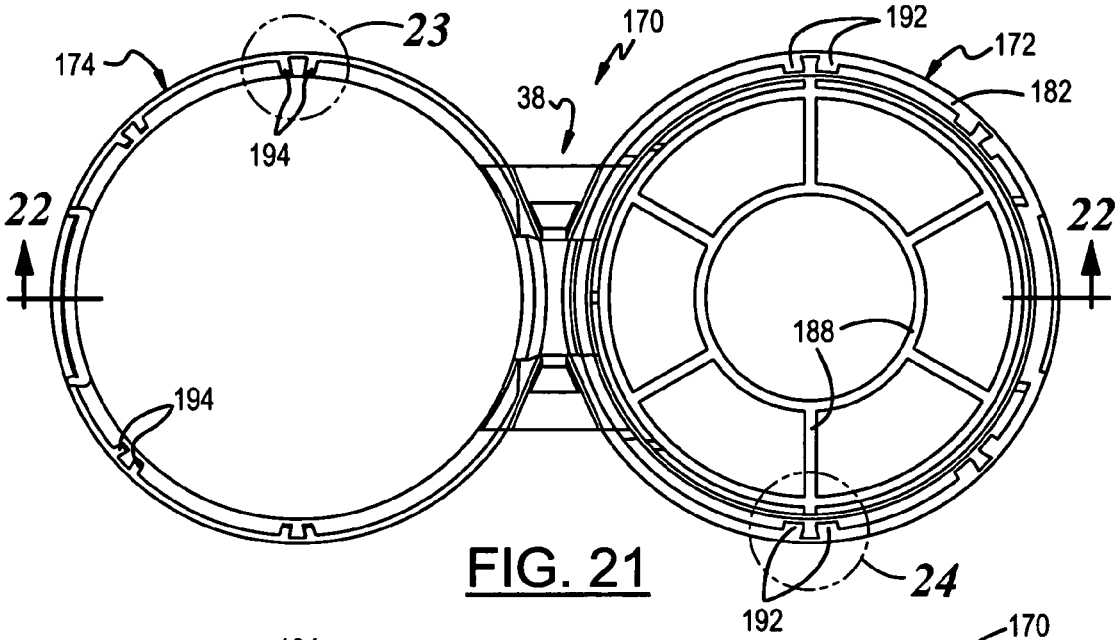
FIG. 21 is a top plan view of the closure in FIGS. 19 and 20 with the lid open.
Figure 22:
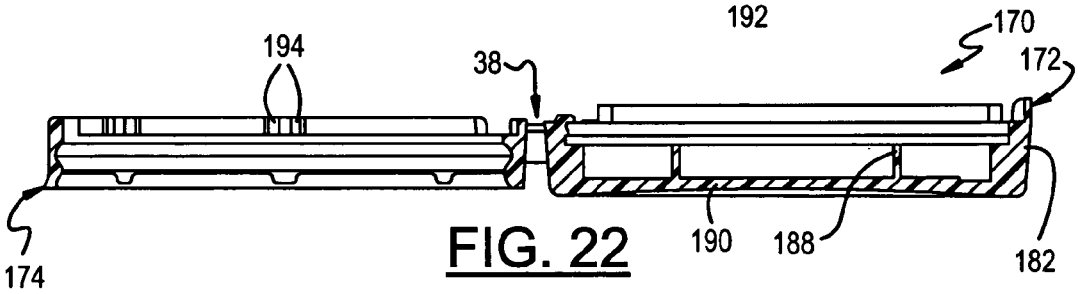
FIG. 22 is a sectional view taken substantially along the line 22-22 in FIG. 21.
Figure 23:
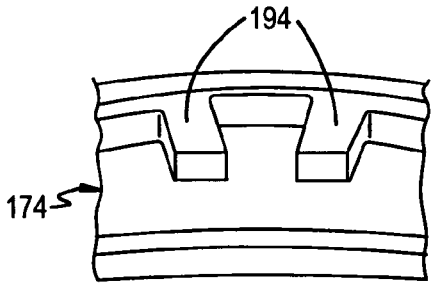
FIGS. 23 and 24 are fragmentary views on enlarged scales of the portions of FIG. 21 within the respective areas 23 and 24.
Figure 24:
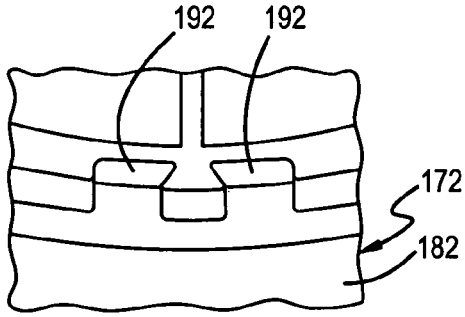

FIGS. 19-20 illustrate a package 170 that includes a closure 172 applied to the neck finish 68 of a container 70. Container 70 is similar to that illustrated in FIGS. 8 and 9. Closure 172 includes a base or ring 174 having a recess 176, formed in part by a snap bead 178, received over ring 74 on neck finish 68. A lid 180 is integrally connected to ring 174 by a hinge 38 as previously described. Lid 180 has a peripheral skirt 182 that is received by snap-fit against ring 174 as previously described. In this embodiment, a seal disk 184 is captured on lid 180 between an internal bead 186 that extends around skirt 182 and a plurality of ribs or other support structures 188 that extend from the underside of the base wall 190 of lid 180. Thus, ribs 188 press disk 184 into sealing engagement with the end of container neck finish 68 when lid 180 is closed, and bead 186 on lid skirt 182 lifts seal disk 184 off of the end of the container neck finish as the lid is opened. Bead 186 may be circumferentially continuous or discontinuous.

Figure 25:
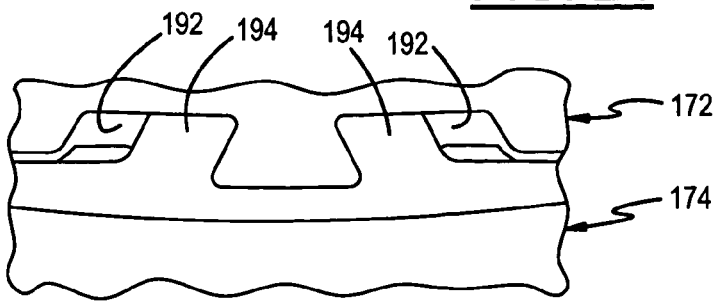
FIG. 25 is a fragmentary perspective view that illustrates the elements of FIGS. 23 and 24 in the closed position of the lid.

FIGS. 21-25 illustrate a feature than can be implemented in closure 172 (FIGS. 19-20) to help align lid 172 with ring 174 as lid 172 is pivoted toward the closed position. Either the lid 172 or ring 174 (lid 172 in the illustrated embodiment) has at least one notch 192, and preferably a plurality of angularly spaced notches 192 around its periphery. The other element (ring 174 in the illustrated embodiment) has at least one lug 194, and preferably a plurality of angularly spaced lugs 194. As lid 172 is moved to the closed position over ring 174, lugs 194 align with notches 192, as shown in FIG. 25, to align lid 172 with ring 174 both circumferentially and laterally. This feature is particularly useful in conjunction with closures of large diameter adapted for use in conjunction with wide-mouth containers.

There thus have been disclosed a plastic closure for a container, particularly a glass container, and a plastic-closure/glass-container package that fully satisfy all of the objects and aims previously set forth. The neck finish of the container has a reduced overall height as compared with prior art constructions having threads or the like for mounting a closure on the container and/or having tamper-indicating means on the container neck finish beneath the thread or crown for mounting the closure. The package of the present disclosure can increase closure application speeds while reducing closure application issues. The closure is a low-profile closure. The exemplary embodiments provide sealing between the closure and the container neck finish, and the preferred laterally spaced hinge element construction provides stability between the closure lid and the closure base.

The disclosure has been presented in conjunction with two presently preferred embodiments, and a number of additional modifications and variations have been described. Other modifications and variations readily will suggest themselves to persons of ordinary skill in the art in view of the foregoing discussion. For example, the exemplary disclosed embodiments are free to rotate around the axis of the container neck finish. However, the closure could be made non-rotatable on the container neck finish, such as by providing internal lugs on ring 34 that are received in external recesses on bead 32 or 74, without departing from the disclosure in its broadest aspects. The disclosure is intended to embrace all such modifications and variations as fall within the spirit and broad scope of the appended claims.

The invention claimed is:

1. A plastic closure for receipt on a container having a neck finish with an end surrounded by an external bead, said closure including:

a plastic ring having an internal recess adapted to be received by snap fit around the container neck finish external bead such that the neck finish bead is captured within said recess and said ring is retained by the external bead against axial movement on the container neck finish, and a plastic lid coupled by a hinge to said ring, said ring, said lid and said hinge being of one-piece integrally molded plastic construction, said lid having a skirt adapted to be releasably snapped to said ring in a closed position of said lid over said ring and with said ring secured by snap fit around the container neck finish bead so that said lid is secured to the neck finish bead only through said ring and is not secured to the neck finish directly, and said skirt having an inside portion adapted to engage an outside portion of the neck finish so as to stabilize the closure on the container.

2. The closure set forth in claim 1 wherein said lid has an external bead on said skirt that is adapted to be received by snap fit in an internal channel on said ring in said closed position of said lid over said ring.

3. The closure set forth in claim 2 wherein said ring has a conical internal surface adjacent to said internal channel for guiding said bead on said lid into said channel on said ring.

4. The closure set forth in claim 1 wherein said lid has an internal bead on said skirt that is adapted to be received by snap fit over an external bead on said ring in a closed position of said lid over said ring.

5. The closure set forth in claim 1 wherein said ring has a conical internal surface facing away from said lid and disposed adjacent to said recess for guiding said ring over the external bead on the container finish.

6. The closure set forth in claim 1 including a foil seal for receipt over the end of the container finish within said ring.

7. The closure set forth in claim 1 wherein said ring is adapted to be disposed at or below the end of the container neck finish when said ring is snapped onto the container neck finish.

8. The closure set forth in claim 1 wherein said ring and said lid have circular external geometries.

9. The closure set forth in claim 1 wherein said ring and said lid have polygonal external geometries.

10. The closure set forth in claim 9 wherein said lid has a point opposite said hinge and said ring has a thumb recess opposite said hinge.

11. The closure set forth in claim 9 wherein said ring has a flat opposite said hinge and said lid has a thumb tab opposite said hinge.

12. The closure set forth in claim 1 wherein said lid has an internal bead, and wherein said closure includes a liner disk carried by said bead within said lid.

13. The closure set forth in claim 12 including internal ribs on said lid to hold a perimeter of said disk against said bead.

14. The closure set forth in claim 1 wherein one of said ring and said lid has notches and the other of said ring and said lid has lugs that cooperate with said notches to align said lid with said ring as said lid is closed against said ring.

15. A plastic closure for receipt on a container having a neck finish with an end surrounded by an external bead, said closure including:

a circumferentially continuous plastic ring having an internal recess adapted to be received by snap fit around the neck finish bead such that said ring lies at or below the end of the container neck finish and the neck finish bead is captured within said recess so that said ring is retained against axial movement on the container neck finish, and a plastic lid coupled by a hinge to said ring, said ring, said lid and said hinge being of one-piece integrally molded plastic construction, said lid having a skirt and an external bead on said skirt, and said skirt having an inside portion adapted to engage an outside portion of the neck finish so as to stabilize the closure on the container, said ring having an internal channel and a conical internal surface adjacent to said channel for guiding said external bead on said lid into said channel on said ring such that said external bead on said lid is received by snap fit in said internal channel on said ring in a closed position of said lid over said ring, said ring having a conical internal surface facing away from said lid and disposed adjacent to said recess in said ring for guiding said ring over the bead on the container neck finish.

16. The closure set forth in claim 15 wherein said lid has an internal bead, and wherein said closure includes a liner disk carried by said internal bead within said lid.

17. The closure set forth in claim 16 including internal ribs on said lid to hold a perimeter of said disk against said internal bead.

18. The closure set forth in claim 15 wherein one of said ring and said lid has notches and the other of said ring and said lid has lugs that cooperate with said notches to align said lid with said ring as said lid is closed against said ring.

19. A package that includes:

a glass container having a neck finish with an end surrounded by an external bead, and a closure that includes:

a plastic ring having an internal recess received by snap fit around said container neck finish bead such that said neck finish bead is captured within said recess and said ring is retained by said external bead against axial movement on said container neck finish, and a plastic lid coupled by a hinge to said ring, said ring, said lid and said hinge being of one-piece integrally molded plastic construction, said lid having a skirt adapted to be releasably snapped to said ring in a closed position of said lid over said ring and with said ring secured by snap fit around said neck finish bead so that said lid is secured to said neck finish bead only through said ring and is not secured to said neck finish directly, and said skirt having an inside portion engaged to an outside portion of the neck finish so as to stabilize the closure on the container.

20. The package set forth in claim 19 wherein said lid has an external bead on said skirt that is adapted to be received by snap fit in an internal channel on said ring in said closed position of said lid over said ring.

21. The package set forth in claim 20 wherein said ring has a conical internal surface adjacent to said internal channel for guiding said bead on said lid into said channel on said ring.

22. The package set forth in claim 19 wherein said lid has an internal bead on said skirt that is adapted to be received by snap fit over an external bead on said ring in a closed position of said lid over said ring.

23. The package set forth in claim 19 wherein said ring has a conical internal surface facing away from said lid and disposed adjacent to said recess for guiding said ring over the external bead on the container finish.

24. The package set forth in claim 19 including a foil seal for receipt over the end of the container finish within said ring.

25. The package set forth in claim 19 wherein said skirt is captured against lateral movement between said bead and said ring in said closed position of said lid.

26. The package set forth in claim 19 wherein said container neck finish has first and second axially spaced external beads, said second external bead including said neck finish outside portion, said ring being received over the first external bead remote from the end of said neck finish and said lid skirt inside portion includes an internal surface that engages the neck finish outside portion of said second external bead adjacent to the end of said neck finish in said closed position of said lid.

27. The package set forth in claim 26 wherein said lid has an external bead at an edge of said skirt and said ring has an internal channel into which said external bead on said lid is received by snap fit, between said external beads on said container neck finish, in said closed position of said lid.

28. The package set forth in claim 19 wherein said ring is disposed at or below the end of the container neck finish.

29. The package set forth in claim 19 wherein said ring and said lid have circular external geometries.

30. The package set forth in claim 19 wherein said ring and said lid have polygonal external geometries.

31. The package set forth in claim 30 wherein said lid has a point opposite said hinge and said ring has a thumb recess opposite said hinge.

32. The package set forth in claim 30 wherein said ring has a flat opposite said hinge and said lid has a thumb tab opposite said hinge.

33. The package set forth in claim 19 wherein said lid has an internal bead, and wherein said closure includes a liner disk carried by said bead within said lid.

34. The package set forth in claim 33 including internal ribs on said lid to hold a perimeter of said disk against said bead.

35. The package set forth in claim 19 wherein one of said ring and said lid has notches and the other of said ring and said lid has lugs that cooperate with said notches to align said lid with said ring as said lid is closed against said ring.

36. The closure set forth in claim 1 wherein said inside portion of said skirt is engageable with a conical external surface on the container neck finish external bead.

37. The closure set forth in claim 1 wherein said inside portion of said skirt is engageable with a conical external surface on another container neck finish external bead axially spaced from the container neck finish external bead.

38. The closure set forth in claim 15 wherein said inside portion of said skirt is engageable with a conical external surface on the container neck finish external bead.

39. The closure set forth in claim 15 wherein said inside portion of said skirt is engageable with a conical external surface on another container neck finish external bead axially spaced from the container neck finish external bead.

40. The package set forth in claim 19 wherein said inside portion of said skirt is engaged with a conical external surface on the container neck finish external bead.

41. The package set forth in claim 19 wherein said inside portion of said skirt is engaged with a conical external surface on another container neck finish external bead axially spaced from the container neck finish external bead.

42. The closure set forth in claim 6 wherein said inside portion of said skirt includes an internal bead to lift said foil seal of the container neck finish as said lid is opened.

43. The closure set forth in claim 24 wherein said inside portion of said skirt includes an internal bead to lift said foil seal of the container neck finish as said lid is opened.

* * * * *